United States Patent [19]

Nagasaka et al.

[11] Patent Number: 4,752,420

[45] Date of Patent: Jun. 21, 1988

[54] DIAPHRAGM CARBURETOR FOR INTERNAL COMBUSTION ENGINE

[75] Inventors: Kohji Nagasaka, Kawasaki; Yoshimi Sejimo, Urayasu; Teruhiko Tobinai, Izumi, all of Japan

[73] Assignee: Walbro Far East, Inc., Kawasaki, Japan

[21] Appl. No.: 36,442

[22] Filed: Apr. 9, 1987

[30] Foreign Application Priority Data

Apr. 18, 1986 [JP] Japan ..... 61-87885

[51] Int. Cl.[4] ..... F02M 17/04

[52] U.S. Cl. ..... 261/35; 261/DIG. 68; 261/DIG. 81

[58] Field of Search ..... 261/35, DIG. 81, DIG. 68

[56] References Cited

U.S. PATENT DOCUMENTS

| | | | |
|---|---|---|---|
| 1,208,196 | 12/1916 | Pembroke | 261/70 |
| 2,252,960 | 8/1941 | Brown | 261/DIG. 81 |
| 3,235,238 | 2/1966 | Martin et al. | 261/DIG. 68 |
| 3,738,622 | 6/1973 | Tuckey | 261/35 |
| 4,271,093 | 6/1981 | Kobayashi | 261/35 |
| 4,563,311 | 1/1986 | Agnew | 261/DIG. 81 |
| 4,597,915 | 7/1986 | Nagase et al. | 261/DIG. 81 |

FOREIGN PATENT DOCUMENTS

| | | | |
|---|---|---|---|
| 58-200072 | 11/1983 | Japan | 261/36 A |
| 58-211556 | 12/1983 | Japan | 261/36 A |
| 59-103948 | 6/1984 | Japan | 261/DIG. 81 |
| 59-215944 | 12/1984 | Japan | 261/36 A |

*Primary Examiner*—Tim Miles

*Attorney, Agent, or Firm*—Barnes, Kisselle, Raisch, Choate, Whittemore & Hulbert

[57] ABSTRACT

A diaphragm carburetor for small internal combustion engines of generally standard construction but improved features for facilitating hot starting due to engine heat or environmental heat which transmits to the carburetor. An automatic or manual relief passage from the diaphragm chamber relieves pressure on fuel due to heat conductors so that a rich fuel charge will not be forced into the engine but will release to atmosphere, thus permitting a normal fuel mixture to be directed to the fuel mixing passage upon a restart of the engine.

2 Claims, 2 Drawing Sheets

DIAPHRAGM CARBURETOR FOR INTERNAL COMBUSTION ENGINE

FIELD OF INVENTION

The present invention relates to a diaphragm carburetor for the internal combustion engine, and particularly to a diaphragm carburetor for the internal combustion engine which is excellent in hot restartability.

BACKGROUND AND OBJECTS OF THE INVENTION

Generally, hot restartability of a small internal combustion engine provided with diaphragm carburetor is not good for several reasons mentioned below:

(1) A metering chamber is heated by heat of the engine, atmosphere heat, radiant heat of sunshine and the like after the engine has been suspended. This occurs conspicuously particularly after operation with high load under a burning sun in a summer season. If the metering chamber is heated as described above, fuel having a low boiling point interiorly stored is changed into vapor and flows from a fuel passage to an air inlet and a venturi portion. At that time, liquid fuel having a high boiling point also flows out together, which stays as vapor liquid in the air inlet and venturi and flows into a crank case depending on the attitude of the engine.

(2) Particularly, in 15 to 20 minutes or so after the operation of the engine has been suspended, the fuel in the metering chamber completely flows into the air inlet, and the interior is filled with fuel vapor.

(3) When a recoil starter is pulled to restart the engine, fuel remaining in the air inlet and venturi portion is taken into the engine all at once and supplied in the form a super-rich mixture. Therefore, the engine will not start.

Particularly, at the time of restarting the engine within a period of 15 to 20 minutes after the engine has been stopped, the engine is still in a hot state requiring no rich-mixture, and therefore, when the super-rich mixture is supplied, the engine is more difficulty to start.

(4) In such a state as described above, roping, that is, pulling the starting cable of a recoil starter, is carried out for several times to discharge the mixture, and the initial explosion could be effected only when the fuel mixture in the interior of the cylinder is in the range of combustion.

(5) When a throttle valve is opened and roping is effected at a start position, a mixture may be exhausted with less roping to effect the initial explosion. However, since the throttle valve is opened, venturi pressure is sufficiently low that it is difficult to clear the vapor in the metering chamber, and even if the initial explosion is effected, the engine is not possible to continue running but stops soon. Even if roping is effected over and over again thereafter, the engine will not start.

(6) In the case where the throttle valve is in a less open position as in idling, roping has to be done over and over again to exhaust the rich mixture from the venturi passage. A spark plug may become covered with the mixture depending on the displacement of the engine and the position of the ignition plug, and this also makes restart more difficult.

(7) The outflow of fuel in the air inlet and venturi portion of the metering chamber after the operation of the engine has been suspended makes it difficult to provide hot restart even if the throttle valve portion is opened and even in the idling position.

(8) When the choke valve is used in the state wherein the engine is hot, fuel remaining in the air inlet is supplied in its richer state to the engine and therefore the engine is again difficult to restart.

As one means for solving these problems noted above, the present applicants have previously proposed a restarting fuel supply device provided with a diaphragm carburetor for the internal combustion engine in which a jet is provided in the midst of a hose connecting an upper opening of a fuel tank and an opening of an intake pipe adjacent to an air inlet of the engine, an air intake is provided at a downstream of the jet, the air intake and the jet being normally closed, and at the restart under high temperature, the air intake and the jet are opened, and at the same time, air is introduced from the outside to the bottom portion internally of the fuel tank through a check valve, said air being introduced as bubbles from a porous member to the inside of the fuel.

In the above-described restarting fuel supply device provided with a diaphragm carburetor for the internal combustion engine, even if the engine is in the high temperature state experienced after the operation has been suspended or the like, the opening and closing valve of the restarting fuel supply mechanism may be opened to thereby supply fuel gas (vapor) at the upper portion of the fuel tank together with air taken from the air inlet to the intake pipe at the downstream of the carburetor. However, in the aforesaid restart state, since the intake passage is low in intake pressure, it is not possible to draw the fuel vapor satisfactorily, and, in addition, a measure for preventing fuel collection in the metering chamber, after the engine has stopped, from being heated by the heat of the engine or environmental heat and flowing into the intake passage has not been taken. Thus, super-rich fuel is supplied to the intake passage at the time of restart, and the hot restartability of the engine is not always good.

BRIEF DESCRIPTION OF THE INVENTION

In view of the foregoing, the present invention provides a diaphragm carburetor for the internal combustion engine utilizing a metering chamber of the diaphragm carburetor, and an exhaust valve provided on the metering chamber, the exhaust valve being adapted to close the metering chamber during operation for the engine while opening the metering chamber to atmosphere when the engine is not operating, whereby when the metering chamber is heated after the engine has been suspended, fuel within the metering chamber is discharged into atmosphere to avoid the occurrence of the problem as noted above.

For achieving the aforementioned object, the present invention provides an arrangement wherein an exhaust valve is provided in a metering chamber of a diaphragm carburetor, the exhaust valve closing the metering chamber during operation of the engine while opening the chamber to atmosphere during standing of the engine.

BRIEF DESCRIPTION OF THE DRAWINGS

DRAWINGS accompany the disclosure and the various views thereof may be briefly described as.

DETAILED DESCRIPTION OF THE INVENTION

When a metering chamber 27 of a diaphragm carburetor 1 is heated after the engine has been stopped, fuel in the chamber 27 is expanded to open the exhaust valve to exhaust it into atmosphere to prevent fuel from being injected into an air inlet. In restarting the engine, a choke valve is fully closed, and the metering chamber 27 is filled with fuel by single roping. When the choke valve is then opened to effect roping, restarting may be readily accomplished because the metering chamber 27 is filled with fuel, and thereafter operation of the engine is rendered smooth.

Figure 1:
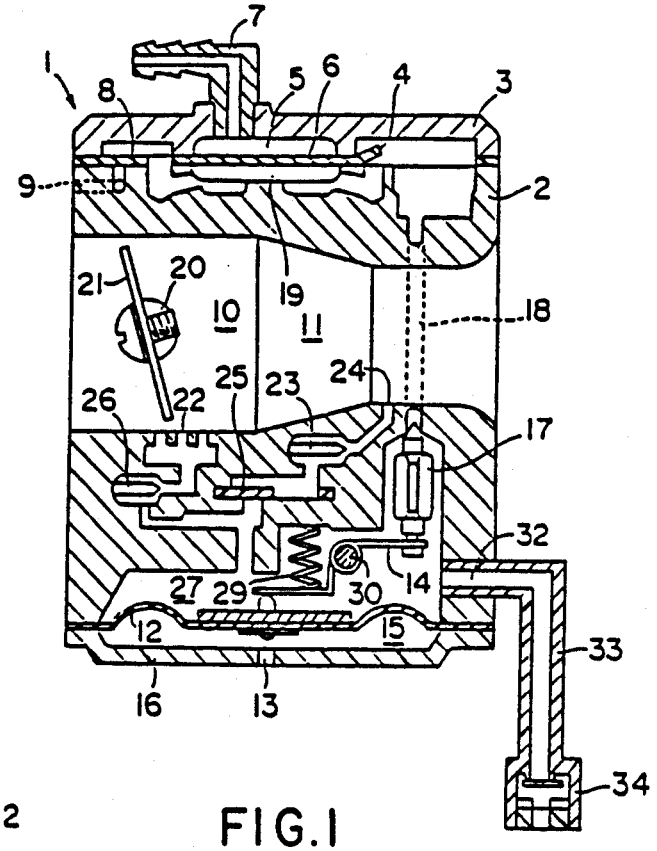
FIG. 1 is a sectional view of a first embodiment according to a diaphragm carburetor for the internal combustion engine of the present invention.

A first embodiment of the present invention will be described with reference to FIG. 1.

In this embodiment, a cover 3 is connected through a diaphragm 6 to the upper wall of a carburetor body 2 provided with venturi 11 in an intake passage 10 with a valve 21 mounted on a shaft 20, and a cover 16 is connected to the lower wall thereof through a diaphragm 12.

A pulsating pressure inlet 7 provided in the cover 3 is connected to a crank chamber of a two-cycle engine, and the pulsating pressure acts on the diaphragm 6 of a pulsating pressure inlet chamber 5 constituting a fuel pump. A fuel chamber 19 defined by the diaphragm 6 is connected to an inlet 9 through a check valve 8, and is connected to a metering chamber 27 through a check valve 4, a passage 28 and an inlet valve 17.

An atmospheric chamber 15 between a diaphragm 12 defining the metering chamber 27 and the cover 16 is opened into atmosphere through an atmospheric port 13. An inlet valve 17 in the form of a needle valve is disposed at the end of a passage 18 and is opened and closed by means of a lever 14. That is, one end of the lever 14 pivotally supported on the wall of the metering chamber 27 by means of a shaft 30 is biased into engagement with the end of the inlet valve 17 by the pressure of a spring 29. The other end of the lever 14 abuts on a projection connected generally on the center of the diaphragm 12. The metering chamber 27 is connected through a check valve 25 to a high speed fuel jet 24 of the intake passage 10 and is connected to a low speed fuel jet 22 through a low speed fuel meter in valve 26.

One way valve 34 in the form of an exhaust valve is provided through a discharge passage 33 on an outlet 32 of the side wall of the metering chamber 27. The one way valve 34 is closed during operation by the negative pressure of the metering chamber 27 but opens the chamber 27 into atmosphere after the engine has stopped.

Next the operation of the embodiment will be described.

In a manner similar to a conventional diaphragm carburetor of the same kind, fuel in a fuel tank, not shown, is supplied, by the diaphragm operated by the pulsating pressure of the crank chamber of the engine, to the metering chamber 27 through the check valve 8, fuel chamber 19, check valve 4, passage 18, inlet valve 17 and the like. However, fuel pressure of the chamber 27 is maintained at a predetermined level by the spring 29 acting on the lever 14 pivotally mounted about the shaft 30. The diaphragm 12 is subject to atmospheric pressure on one side, and the fuel is injected into the intake passage 10 through the low speed fuel metering needle valve 26 or high speed fuel metering needle valve 23 according to the opening degree of the throttle valve 21 and supplied to the engine. In addition, the following operation will be made.

The metering chamber 27 of the diaphragm carburetor 1, when heated after the engine has been stopped, causes fuel in the chamber 27 to expand to open the one way valve 34 thereby preventing fuel in the metering chamber 27 from being injected into the air inlet when the engine is stopped. In restarting the engine, the choke valve is fully opened and fuel is filled in the metering chamber 27 by a single pull of the starter cable. Then, when the choke valve is opened for further roping, restarting may be readily accomplished because the metering chamber 27 is filled with fuel, and thereafter operation of the engine may be carried out smoothly.

The one way valve 34 system is easy to operate and is advantageous for use with a carburetor of a small engine for working machines which involve less vibration such as a cutter.

Figure 2:
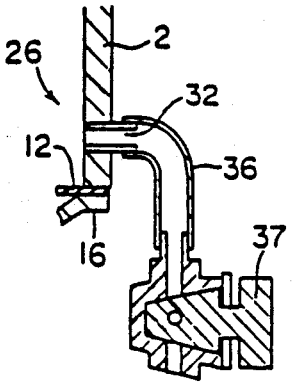
FIG. 2 is a sectional view showing essential parts of a second embodiment thereof.

Next, a second embodiment of the present invention will be described with reference to FIG. 2 showing essential parts in longitudinal section.

In this embodiment, a hand-operated tapered cock 37 in the form of an exhaust valve is provided on an outlet 32 of the metering chamber 27 through a discharge passage 36. According to this embodiment, when the hand-operated tapered cock 37 is opened after the engine has been stopped, fuel heated within the metering chamber 27 is discharged outside through the outlet 32 and the discharge passage 36. In restarting the engine, the hand-operated tapered cock 37 is closed, the choke is fully closed, and the recoil starter is pulled once to introduce fuel into the metering chamber 27. Other constructions and operations are similar to those of the first embodiment shown in FIG. 1.

Figure 3:
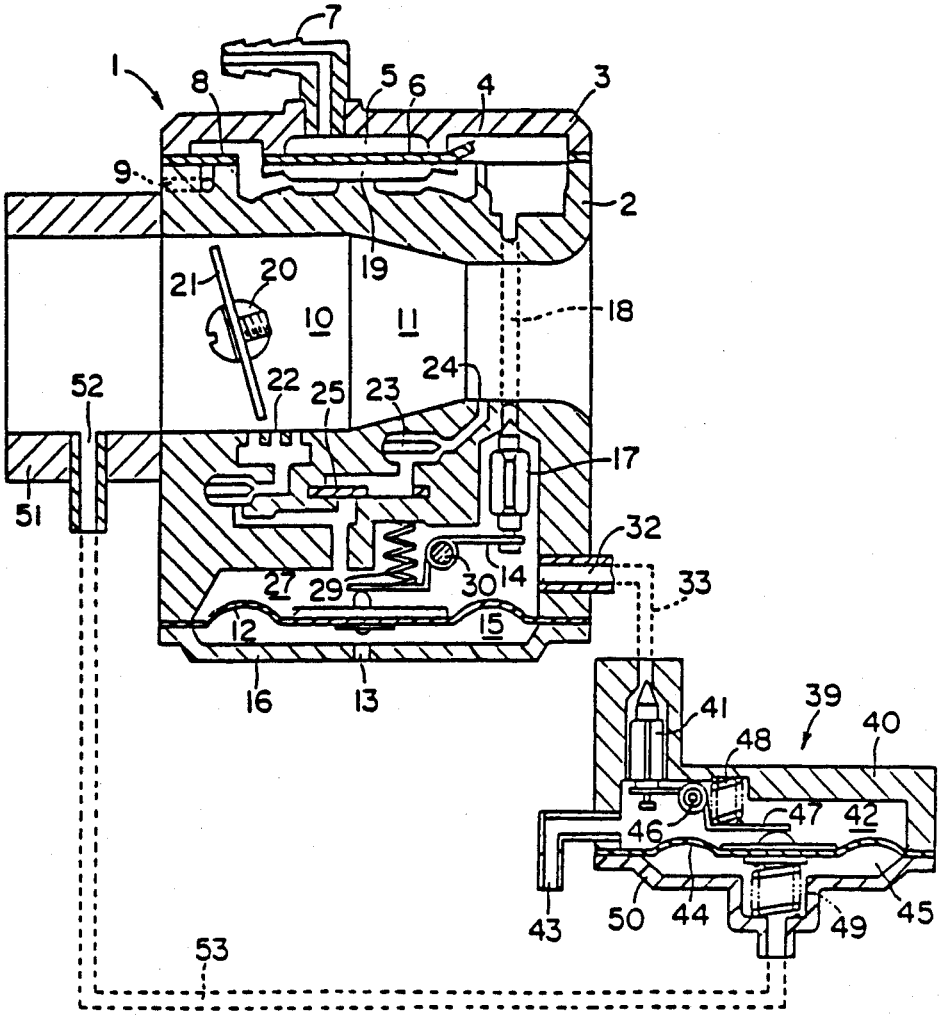
FIG. 3 is a sectional view of a third embodiment thereof.

A third embodiment of the present invention will now be described with reference to FIG. 3. It is noted that parts corresponding to those of the first and second embodiments shown in FIGS. 1 and 2 are indicated by the same designations and reference numerals.

According to the third embodiment, a negative pressure valve 39 in the form of an exhuast valve is provided on the outlet 32 of the metering chamber 27 through a discharge passage 33. This negative pressure valve 39 comprises an atmospheric chamber 42 and a negative pressure chamber 45 formed by a cover 50 mounted on the negative pressure body 39 below a diaphragm 44, the atmospheric chamber 42 being connected to the discharge passage 33 through a needle valve 41. On the other hand, the atmospheric chamber 42 is opened through an exhaust port 43. The needle valve 41 comes into contact with one end of a lever 47 supported by a shaft 46 on the wall of the valve body 40, and the other end of the lever 47 is always in contact with a central portion of the diaphragm 44 by means of a spring 48. The diaphragm 44 is pressed by the spring 49 but the negative pressure chamber 45 is connected through a passage 53 to an opening 52 of a heat insulating tube 51 continuous to the intake passage 10 and is attracted by the negative pressure against the spring 49 during operation of the engine whereby the needle valve 41 causes the discharge passage 33 to be closed through the lever 47 and the metering chamber 27 is closed. When the engine is stopped, negative pressure of the negative pressure chamber 45 ceases to exist, the diaphragm 44 is urged by the spring 49, the lever 47 is pivotally moved counterclockwise against the spring 48 to move the needle valve 41 backward, and the metering chamber 27 is then opened to atmosphere through the discharge passage 33.

According to this embodiment, fuel is supplied to the engine similarly to the diaphragm carburetor described in the first embodiment, and in addition the following operation will be made.

When intake pressure ceases to exist after the engine has been suspended, the diaphragm 44 is urged by the spring of the negative pressure chamber 45 of the negative pressure valve 39, the discharge passage 33 is opened by the needle valve 41 through the lever 47, and the metering chamber 27 is opened into the atmosphere through the discharge passage 33, the atmospheric chamber 42 and the exhaust port 43. Under this state, when the metering chamber 27 of the diaphragm carburetor 1 is heated by the heat of the engine or the like, fuel within the chamber 27 is changed into vapor fuel and internal pressure thereof increases. Therefore, the vapor fuel within the chamber 27 is discharged into atmosphere through the negative pressure valve 39 but not injected toward the intake passage 10 passing through the jets 22 and 44. With this, super-rich fuel will not be supplied to the intake of the engine, and the hot restartability of the engine is not deteriorated.

According to the present invention, as described above, fuel can be supplied in a manner similar to a conventional diaphragm carburetor for the internal combustion engine, and in addition the following effects may be obtained:

(1) Since the exhaust valve is provided in the metering chamber of the diaphragm carburetor to close the metering chamber during operation of the engine and to open the chamber into atmosphere during standing of the engine, fuel in the metering chamber is not moved toward the air inlet after the engine has been suspended, and the hot restartability of the engine is not deteriorated.

(2) Since fuel in the metering chamber is discharged into atmosphere after the engine has been stopped and fuel in the metering chamber is not forced into the intake passage, the choke valve is closed, at the time of hot restarting, and the recoil starter is pulled once whereby the metering chamber can be filled with fuel in a proper ratio of mixture. Subsequently, when the choke valve is opened and the recoil starter is pulled, fuel may be supplied to the engine so that the latter may be easily restarted.

(3) Since the construction is so simple that the exhaust valve is provided in the metering chamber to be closed during operation of the engine and opened during standing of the engine, the present invention may be easily embodied also for the existing carburetor.

Furthermore, the exhaust valve is made to comprise a hand-operated tapered cock, the exhaust passage of the metering chamber may be closed positively. Therefore, the present carburetor is suitable as a diaphragm carburetor for a small engine for working machines which involve great vibrations and generate a large quantity of dust such as chain saws.

Moreover, if the exhaust valve is made to comprise a negative pressure valve actuated by intake pressure, the operation of the exhaust valve becomes more positive.

What is claimed is:

1. A diaphragm carburetor for use in supplying fuel to an internal combustion engine and having a fuel mixing passage and diaphragm chamber with a metering chamber to receive fuel from a fuel supply source in response to subatmospheric pressure in said metering chamber, said metering chamber being open to said mixing passage through a high speed fuel jet and low speed fuel jets above said metering chamber, that improvement which comprises:

(a) an outlet passage leading from a position adjacent the liquid containing area of the metering chamber to a discharge to atmosphere outside and below said fuel jets and said metering chamber, said passage being unrestricted under conditions when said carburetor is not supplying fuel to an engine, and (b) a valve in said outlet passage responsive to subatmospheric pressure in said metering chamber to close said outlet passage when said carburetor is supplying fuel to an engine, whereby when said carburetor is not functioning to supply fuel to an engine, expansion of liquid fuel will dump outside said carburetor.

2. A diaphragm carburetor as defined in claim 1 in which said valve comprises a valve element cooperating with a seat in said outlet passage, a lever mechanically associated with said valve to move said valve from an open position to a closed position, first means resiliently biasing said lever to a position wherein said valve is closed, a control diaphragm operatively associated with said lever, second means biasing said diaphragm in a direction to oppose the bias of said first means and having a degree of bias to overcome the bias of said first means to effect shifting of said valve to an open position, and a conduit connecting one side of said diaphragm to said mixing passage to transmit subatmospheric pressure to said diaphragm when an engine is operating, to overcome the bias of said second means and effect closing of said valve by the action of said lever and said first biasing means.

* * * * *